US011346609B2

(12) United States Patent
Satou et al.

(10) Patent No.: US 11,346,609 B2
(45) Date of Patent: May 31, 2022

(54) HEAT EXCHANGER

(71) Applicant: Daikin Industries, LTD., Osaka (JP)

(72) Inventors: Ken Satou, Osaka (JP); Kouju Yamada, Osaka (JP); Masanori Jindou, Osaka (JP); Yoshio Oritani, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/614,670

(22) PCT Filed: Jun. 27, 2018

(86) PCT No.: PCT/JP2018/024402

§ 371 (c)(1),
(2) Date: Nov. 18, 2019

(87) PCT Pub. No.: WO2019/009158

PCT Pub. Date: Jan. 10, 2019

(65) Prior Publication Data

US 2020/0166278 A1 May 28, 2020

(30) Foreign Application Priority Data

Jul. 3, 2017 (JP) ..... JP2017-130542

(51) Int. Cl.
*F28D 1/04* (2006.01)
*F28D 1/047* (2006.01)
(Continued)

(52) U.S. Cl.
CPC ..... *F28D 1/047* (2013.01); *F28F 1/02* (2013.01); *F28F 1/32* (2013.01)

(58) Field of Classification Search
CPC ..... F28D 1/047; F28F 1/02; F28F 1/32
(Continued)

(56) References Cited

U.S. PATENT DOCUMENTS 3,687,194 A * 8/1972 Scholl ..... F28F 1/12 165/180
2005/0061494 A1* 3/2005 Tsuji ..... F28F 1/32 165/173

(Continued)

FOREIGN PATENT DOCUMENTS

JP H04-043292 A 2/1992
JP H06-307785 A 11/1994

(Continued)

OTHER PUBLICATIONS

International Search Report issued in corresponding International Application No. PCT/JP2018/024402 dated Sep. 18, 2018, with translation (5 pages).

(Continued)

*Primary Examiner* — Davis D Hwu
(74) *Attorney, Agent, or Firm* — Osha Bergman Watanabe & Burton LLP

(57) ABSTRACT

A heat exchanger includes: flat pipes arranged such that flat surfaces of the flat pipes are opposed to one another; and fins each including insertion parts that extend in an insertion direction that crosses a direction in which the flat pipes are disposed and a longitudinal direction of the flat pipes. At least part of each of the flat pipes is inserted into a corresponding one of the insertion parts. Each of the fins includes a cut-and-raised part that is cut and raised in a thickness direction between the insertion parts, and a rib disposed between the insertion part and the cut-and-raised part.

15 Claims, 12 Drawing Sheets

(51) Int. Cl.
*F28F 1/02* (2006.01)
*F28F 1/32* (2006.01)

(58) Field of Classification Search
USPC ..... 165/151
See application file for complete search history.

(56) References Cited

U.S. PATENT DOCUMENTS

| | | | | |
|---|---|---|---|---|
| 2009/0266527 | A1* | 10/2009 | Helms | F28D 1/0391 165/151 |
| 2012/0031601 | A1* | 2/2012 | Matter, III | F28F 1/025 165/177 |
| 2019/0145716 | A1* | 5/2019 | Sassanelli | F28F 13/06 165/151 |
| 2019/0170372 | A1* | 6/2019 | Yoshioka | F24F 1/0063 |

FOREIGN PATENT DOCUMENTS

| | | | |
|---|---|---|---|
| JP | 2012-233680 | A | 11/2012 |
| JP | 2016-084975 | A | 5/2016 |

OTHER PUBLICATIONS

International Preliminary Report on Patentability issued in PCT/JP2018/024402 dated Jan. 16, 2020, with translation (12 pages).
Extended European Search Report issued in corresponding European Application No. 18829085.2 dated Dec. 9, 2020 (4 pages).

* cited by examiner

HEAT EXCHANGER

TECHNICAL FIELD

The present invention relates to a heat exchanger.

BACKGROUND

Conventionally known is a heat exchanger that includes a plurality of flat perforated pipes and a fin joined to the plurality of flat perforated pipes, the heat exchanger exchanging heat between a refrigerant flowing inside the flat perforated pipes and air flowing outside of the flat perforated pipes.

For example, Patent Literature 1 (Japanese Unexamined Patent Application Publication No. 2012-233680) proposes a heat exchanger provided with a plurality of cut-and-raised pieces between flat perforated pipes in a fin to improve heat transfer performance of the fin.

In the heat exchanger disclosed in Patent Literature 1, when the fin and the flat perforated pipe are brazed together, the fin is annealed, and the strength is reduced. The Patent Literature 1 focuses on buckling of the fin when the whole heat exchanger is, for example, bent while the fin and the flat perforated pipe are joined together. A flap part having no cut-and-raised part is provided on a continuous part of the fin, and then the buckling of the fin is suppressed.

However, at the time of insertion of the flat perforated pipe into the fin before brazing of the fin and the flat perforated pipe, a friction is caused between the fin and the flat perforated pipe, and then great stress may be applied to the fin. In particular, when the cut-and-raised part is formed on the fin to enhance heat transfer performance, stress concentrates on a part near an end part of the cut-and-raised part at the time of the insertion of the flat perforated pipe, and the fin easily buckles at this part.

PATENT LITERATURE

<Patent Literature 1> Japanese Unexamined Patent Application Publication No. 2012-233680

SUMMARY

One or more embodiments of the present invention provide a heat exchanger capable of suppressing buckling of the fin near a cut-and-raised part of the fin when a flat pipe is inserted into the fin on which the cut-and-raised part is formed.

A heat exchanger according to one or more embodiments includes a plurality of flat pipes and a plurality of fins. The plurality of flat pipes is arranged in such a manner that flat surfaces of the flat pipes are opposed to each other. The fin includes an insertion part. The insertion part extends in an insertion direction. At least part of the flat pipe is inserted into the insertion part. The insertion direction is a direction that crosses both a direction along which the flat pipes are arranged and a longitudinal direction of the flat pipe. The fin further includes a cut-and-raised part and a rib. The cut-and-raised part is cut and raised between a plurality of the insertion parts in a thickness direction. The rib is formed between the insertion part and the cut-and-raised part.

Note that the insertion direction is not limited. The insertion direction may be, for example, a direction that is not orthogonal to but slightly inclined to the direction along which the flat pipes are arranged, or may be a direction that is not orthogonal to but slightly inclined to the longitudinal direction of the flat pipe. An angle of the inclination can be, for example, 45° or less.

The cut-and-raised part is not limited, but may be, for example, a louver that is cut and raised so as to be opened on a windward side but not opened on a leeward side, or may be a slit that is cut and raised so as to be opened on both the windward and leeward sides. Note that the openings on the windward and leeward sides of the slit may be formed on the same side in the thickness direction of the fin, or on the sides different from each other.

The rib is not limited, but may be formed, for example, along the insertion direction between the insertion part and the cut-and-raised part, or may be formed in such a manner that the insertion direction is a longitudinal direction of the rib.

This heat exchanger can enhance heat transfer performance at the time of heat exchange due to the cut-and-raised part formed on the fin. When the flat pipe is inserted into the fin thus provided with cut-and-raised part, friction between the fin and the flat pipe causes stress on the fin. The stress concentrates particularly near a part where friction is caused in the cut-and-raised part. The fin may buckle with this part as an initiating point.

However, since the rib is formed between the insertion part and the cut-and-raised part in this heat exchanger, the stress concentration near the cut-and-raised part of the fin at the time of the insertion of the flat pipe can be relaxed. Therefore, the buckling of the fin near the cut-and-raised part can be suppressed.

According to one or more embodiments, the rib is formed at least on an insertion advancing side in the insertion direction with respect to a part of the insertion part of the fin, the part being touched by the flat pipe first when the flat pipe is inserted into the fin.

In this heat exchanger, the ribs are formed on the part of the fin on which the stress is likely to concentrate when the flat pipe is inserted, that is, the part on the insertion advancing side with respect to the part that the flat pipe first touches when the flat pipe is inserted into the fin. As a result, the stress on the part of the fin where the stress is likely to concentrate when the flat pipe is inserted can be reduced.

According to one or more embodiments, the fin includes a plurality of the cut-and-raised parts aligned in the insertion direction of the flat pipe. The rib continuously extends between the insertion part and the plurality of cut-and-raised parts along the insertion direction of the flat pipe.

Note that the rib preferably continuously extends in the insertion direction of the flat pipe so as to cover at least a region where the cut-and-raised parts exist.

Extending along the insertion direction is not limited to extending in parallel with the insertion direction, but includes a case where the longitudinal direction of the rib and the insertion direction are in parallel or substantially in parallel with each other.

The plurality of cut-and-raised parts is provided on the fin of this heat exchanger so as to be aligned in the insertion direction of the flat pipe. This can improve the heat transfer performance of the fin.

When, for example, the plurality of cut-and-raised parts is aligned on the fin, even though the rib is formed only between any one of the cut-and-raised parts and the insertion part, the buckling may occur near an end part of another cut-and-raised part when the flat pipe is inserted.

However, in this heat exchanger, the rib continuously extends in the insertion direction of the flat pipe between the insertion part and the plurality of cut-and-raised parts. Even when the fin provided with the plurality of cut-and-raised parts is used, therefore, the buckling near the end part of the cut-and-raised parts can be suppressed.

According to one or more embodiments, the rib continuously extends further to the insertion advancing side with respect to the cut-and-raised part located furthest on the insertion advancing side in the insertion direction of the flat pipe among the plurality of cut-and-raised parts located between the insertion parts adjacent to each other.

This heat exchanger can suppress the buckling near the end parts of all the plurality of cut-and-raised parts located between the insertion parts adjacent to each other.

According to one or more embodiments, the fin includes a fin collar that is formed so as to fringe the insertion part and is opposed to the flat surface of the flat pipe. The rib is formed between the fin collar and the cut-and-raised part.

Note that the insertion part of the fin and the flat surface of the flat pipe may be opposed to and in direct contact with each other, or may be opposed to each other via, for example, a brazing material.

For example, a thickness of the fin collar in the thickness direction of the fin is preferably larger than a thickness of an adjacent part of the fin collar in the thickness direction of the fin.

In this heat exchanger, the fin includes the fin collar that is opposed to the flat surface of the flat pipe. As a result, when the flat pipe is inserted, a great friction is easily caused between the flat surface of the flat pipe and the fin collar of the fin, and the concentration of the greater stress easily occurs near the end part of the cut-and-raised part of the fin.

However, since the rib is formed between the fin collar and the cut-and-raised part in this heat exchanger, even though the great stress is applied via the fin collar when the flat pipe is inserted, the concentration of the great stress is suppressed, and the buckling of the fin can be suppressed.

According to one or more embodiments, the fin includes the rib that is formed between the cut-and-raised part and the insertion part on each side of the cut-and-raised part.

In this heat exchanger, the rib is formed both between the cut-and-raised part and the insertion part located on one side of the cut-and-raised part and between the cut-and-raised part and the insertion part located on the other side of the cut-and-raised part. This can suppress the buckling near both of the end parts of the cut-and-raised part.

According to one or more embodiments, the rib is formed by raising a part of the fin in the thickness direction.

The rib formed by being raised may include, for example, a rising part that rises toward one side of the thickness direction until reaching a top part as viewed from a part on the side of the nearest insertion part, the top part, and a falling part that falls from the top part toward an opposite side of the thickness direction. Here, a position of the rising part in the thickness direction before rising and a position of the falling part in the thickness direction after falling may be the same or different.

The rib is formed by the fin being raised in the thickness direction, and thus this heat exchanger can enhance the strength of the rib.

DETAILED DESCRIPTION

Hereinafter, embodiments of an air conditioner that adopts an outdoor heat exchanger and modifications of the embodiments will be described based on the drawings. Note that a detailed configuration of the outdoor heat exchanger is not limited to that described in the embodiments and the modifications of the embodiments, but variations should be possible without departing from the gist of the embodiments and the modifications of the embodiments.

(1) Configuration of Air Conditioner

Figure 1:
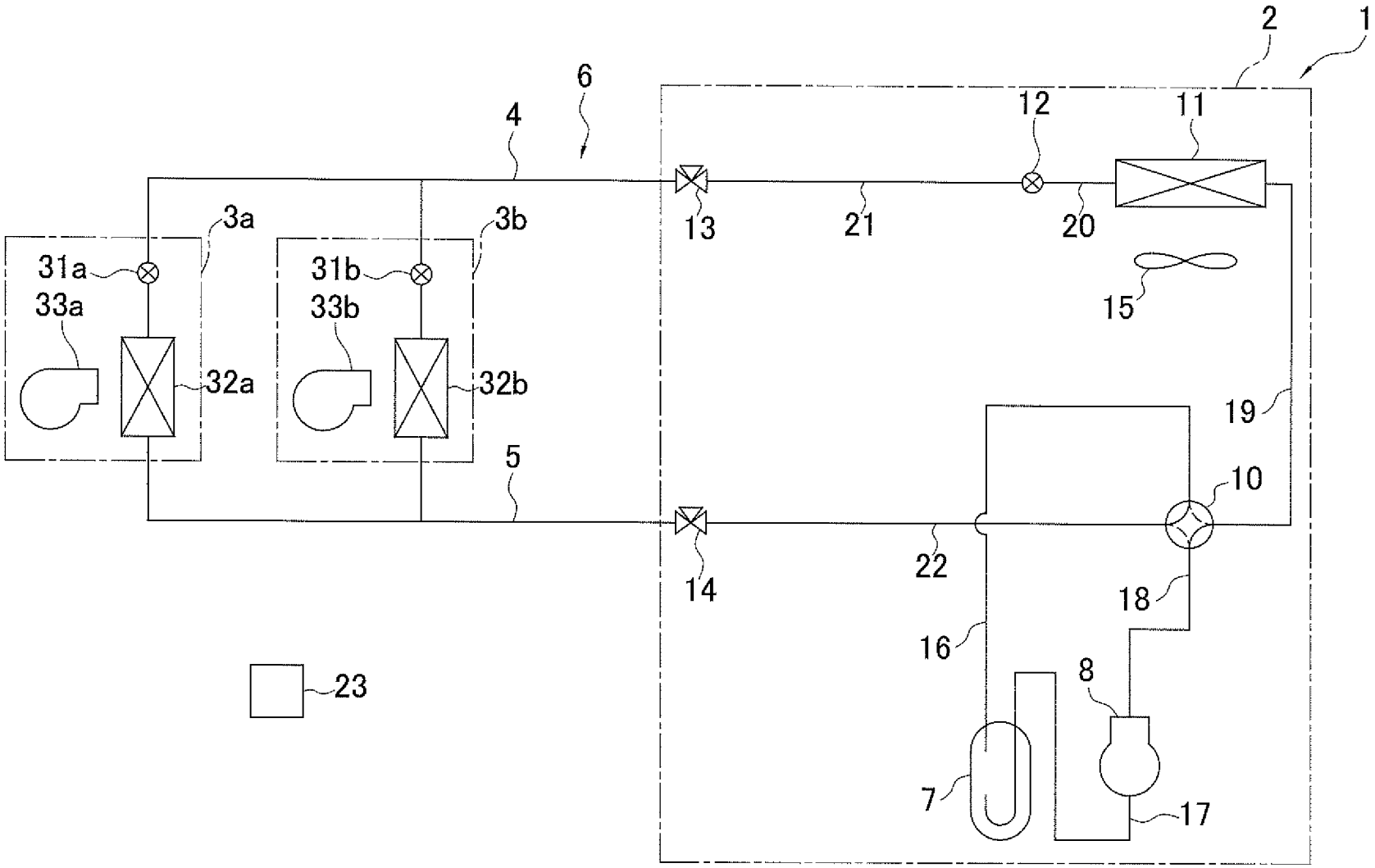
FIG. 1 is a schematic configuration diagram of an air conditioner that adopts a heat exchanger according to one or more embodiments.

FIG. 1 is a schematic configuration diagram of an air conditioner 1 that adopts an outdoor heat exchanger 11 as a heat exchanger according to one or more embodiments.

The air conditioner 1 is an apparatus capable of cooling and heating a room of a building and the like by performing a vapor compression refrigeration cycle. The air conditioner 1 mainly includes an outdoor unit 2, indoor units 3*a* and 3*b*, a liquid-refrigerant connection pipe 4 and a gas-refrigerant connection pipe 5 that connect the outdoor unit 2 and the indoor units 3*a* and 3*b*, and a control unit 23 that controls components of the outdoor unit 2 and the indoor units 3*a* and 3*b*. A vapor compression refrigerant circuit 6 of the air conditioner 1 is configured by connecting the outdoor unit 2 and the indoor units 3*a* and 3*b* via the connection pipes 4 and 5.

The outdoor unit 2 is installed outdoors (for example, on a rooftop of a building, or near a wall surface of a building), and configures part of the refrigerant circuit 6. The outdoor unit 2 mainly includes an accumulator 7, a compressor 8, a four-way switching valve 10, an outdoor heat exchanger 11, an outdoor expansion valve 12 as an expansion mechanism, a liquid-side shutoff valve 13, a gas-side shutoff valve 14, and an outdoor fan 15. The components and valves are connected by refrigerant pipes 16 to 22.

The indoor units 3*a* and 3*b* are installed indoors and configure part of the refrigerant circuit 6. The indoor unit 3*a* mainly includes an indoor expansion valve 31*a*, an indoor heat exchanger 32*a*, and an indoor fan 33*a*. The indoor unit 3*b* mainly includes an indoor expansion valve 31*b* as an expansion mechanism, an indoor heat exchanger 32*b*, and an indoor fan 33*b*.

One end of the liquid-refrigerant connection pipe 4 is connected to the liquid-side shutoff valve 13 of the outdoor unit 2, and the other ends of the liquid-refrigerant connection pipe 4 are connected to a liquid side of the indoor expansion valves 31*a* and 31*b* of the indoor units 3*a* and 3*b*. One end of the gas-refrigerant connection pipe 5 is connected to the gas-side shutoff valve 14 of the outdoor unit 2, and the other ends of the gas-refrigerant connection pipe 5 are connected to a gas side of the indoor heat exchangers 32*a* and 32*b* of the indoor units 3*a* and 3*b*.

The control unit 23 is configured in such a manner that a control board and the like (not illustrated) that are provided in the outdoor unit 2 and the indoor units 3*a* and 3*b* are communicably connected. Note that, in FIG. 1, the control unit 23 is illustrated in a position apart from the outdoor unit 2 and the indoor units 3*a* and 3*b* for convenience. The control unit 23 controls components 8, 10, 12, 15, 31*a*, 31*b*, 33*a*, and 33*b* of the air conditioner 1 (here, the outdoor unit 2 and the indoor units 3*a* and 3*b*), i.e. an operation of the whole air conditioner 1.

(2) Operation of Air Conditioner

Next, the operation of the air conditioner 1 will be described with reference to FIG. 1. The air conditioner 1 performs a cooling operation and a heating operation, the cooling operation passing a refrigerant through the compressor 8, the outdoor heat exchanger 11, the outdoor expansion valve 12, the indoor expansion valves 31*a* and 31*b*, and the indoor heat exchangers 32*a* and 32*b* in that order, the heating operation passing the refrigerant through the compressor 8, the indoor heat exchangers 32*a* and 32*b*, the indoor expansion valves 31*a* and 31*b*, the outdoor expansion valve 12, and outdoor heat exchanger 11 in that order. Note that the control unit 23 performs the cooling operation and the heating operation.

In the cooling operation, the four-way switching valve 10 is switched to an outdoor heat radiation state (as illustrated in solid lines in FIG. 1). In the refrigerant circuit 6, the low-pressure gas refrigerant in the refrigeration cycle is sucked into the compressor 8 and discharged after being compressed to a high pressure of the refrigeration cycle. The high-pressure gas refrigerant that has been discharged from the compressor 8 is sent to the outdoor heat exchanger 11 via the four-way switching valve 10. The high-pressure gas refrigerant that has been sent to the outdoor heat exchanger 11 exchanges heat with outdoor air supplied as a cooling source by the outdoor fan 15, and radiates heat to be a high-pressure liquid refrigerant in the outdoor heat exchanger 11 that functions as a radiator of the refrigerant. The high-pressure liquid refrigerant that has radiated heat in the outdoor heat exchanger 11 is sent to the indoor expansion valves 31*a* and 31*b* via the outdoor expansion valve 12, the liquid-side shutoff valve 13, and the liquid-refrigerant connection pipe 4. The refrigerant that has been sent to the indoor expansion valves 31*a* and 31*b* is decompressed to the low pressure of the refrigeration cycle by the indoor expansion valves 31*a* and 31*b* to be a low-pressure refrigerant in a gas-liquid two-phase state. The low-pressure refrigerant in the gas-liquid two-phase state that has been decompressed at the indoor expansion valves 31*a* and 31*b* is sent to the indoor heat exchangers 32*a* and 32*b*. The low-pressure refrigerant in the gas-liquid two-phase state that has been sent to the indoor heat exchangers 32*a* and 32*b* exchanges heat with indoor air supplied as a heating source by the indoor fans 33*a* and 33*b* at the indoor heat exchangers 32*a* and 32*b* to vaporize. The indoor air is thus cooled and then supplied into the room, and the room is cooled. The low-pressure gas refrigerant that has vaporized at the indoor heat exchangers 32*a* and 32*b* is sucked again into the compressor 8 via the gas-refrigerant connection pipe 5, the gas-side shutoff valve 14, the four-way switching valve 10, and the accumulator 7.

In the heating operation, the four-way switching valve 10 is switched to an outdoor vaporization state (as illustrated in broken lines in FIG. 1). In the refrigerant circuit 6, the low-pressure gas refrigerant in the refrigeration cycle is sucked into the compressor 8 and discharged after being compressed to a high pressure of the refrigeration cycle. The high-pressure gas refrigerant that has been discharged from the compressor 8 is sent to the indoor heat exchangers 32*a* and 32*b* via the four-way switching valve 10, the gas-side shutoff valve 14, and the gas-refrigerant connection pipe 5. The high-pressure gas refrigerant that has been sent to the indoor heat exchangers 32*a* and 32*b* exchanges heat with indoor air supplied as a cooling source by the indoor fans 33*a* and 33*b* at the indoor heat exchangers 32*a* and 32*b* to radiate heat and to be a high-pressure liquid refrigerant. The indoor air is thus heated and then supplied into the room, and the indoor heating is performed. The high-pressure liquid refrigerant that has radiated heat in the indoor heat exchangers 32*a* and 32*b* is sent to the outdoor expansion valve 12 via the indoor expansion valves 31*a* and 31*b*, the liquid-refrigerant connection pipe 4, and the liquid-side shutoff valve 13. The refrigerant that has been sent to the outdoor expansion valve 12 is decompressed to the low pressure of the refrigeration cycle by the outdoor expansion valve 12 to be a low-pressure refrigerant in a gas-liquid two-phase state. The low-pressure refrigerant in the gas-liquid two-phase state that has been decompressed at the outdoor expansion valve 12 is sent to the outdoor heat exchanger 11. The low-pressure refrigerant in the gas-liquid two-phase state that has been sent to the outdoor heat exchanger 11 exchanges heat with outdoor air supplied as a heating source by the outdoor fan 15, and vaporizes to be a low-pressure gas refrigerant in the outdoor heat exchanger 11 that functions as an evaporator of the refrigerant. The low-pressure refrigerant that has vaporized at the outdoor heat exchanger 11 is sucked again into the compressor 8 via the four-way switching valve 10 and the accumulator 7.

In a state where the outdoor heat exchanger 11 functions as an evaporator of the refrigerant in the heating operation, when an outdoor air temperature and an evaporation temperature of the refrigerant meet a predetermined operation condition, frost may adhere to the outdoor heat exchanger 11. When such frost in a large amount adheres to the outdoor heat exchanger 11, the air supplied from the outdoor fan 15 is subjected to an excessive air flow resistance when passing through the outdoor heat exchanger 11 with frost adhered. This may reduce heat exchange efficiency. Therefore, when a predetermined defrosting determination condition is satisfied, for example, when the predetermined operation condition is kept satisfied for a predetermined time or longer, the control unit 23 switches the four-way switching valve 10 to the outdoor heat radiation state (as illustrated in solid lines in FIG. 1) to perform a defrosting operation. When the defrosting process is completed after, for example, the defrosting operation is performed for a predetermined time, the control unit 23 switches the four-way switching valve 10 to the outdoor vaporization state (as illustrated in broken lines in FIG. 1) again to restart the heating operation.

(3) Configuration of Outdoor Unit

Figure 2:
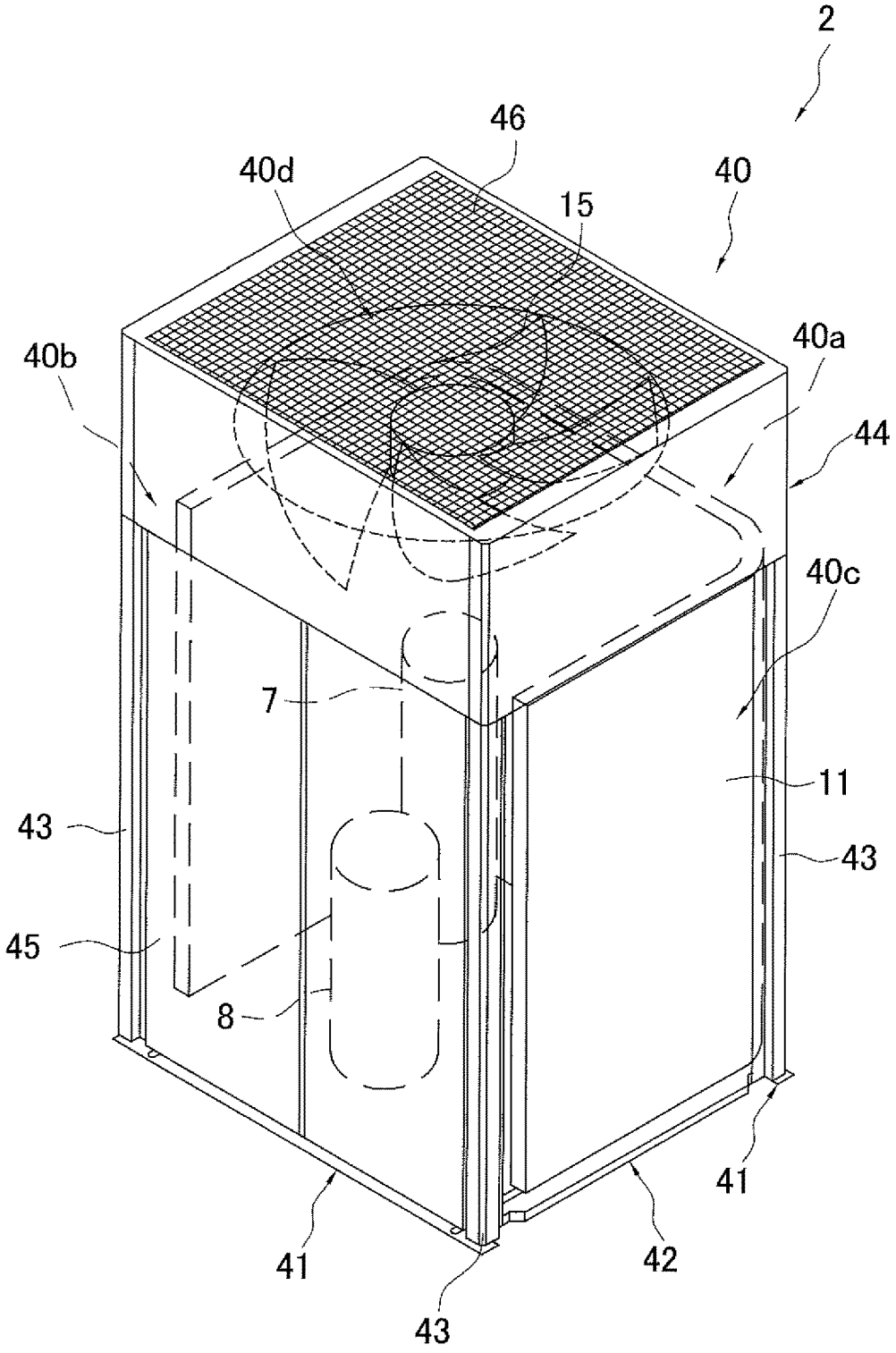
FIG. 2 is an external perspective view of an outdoor unit.
Figure 3:
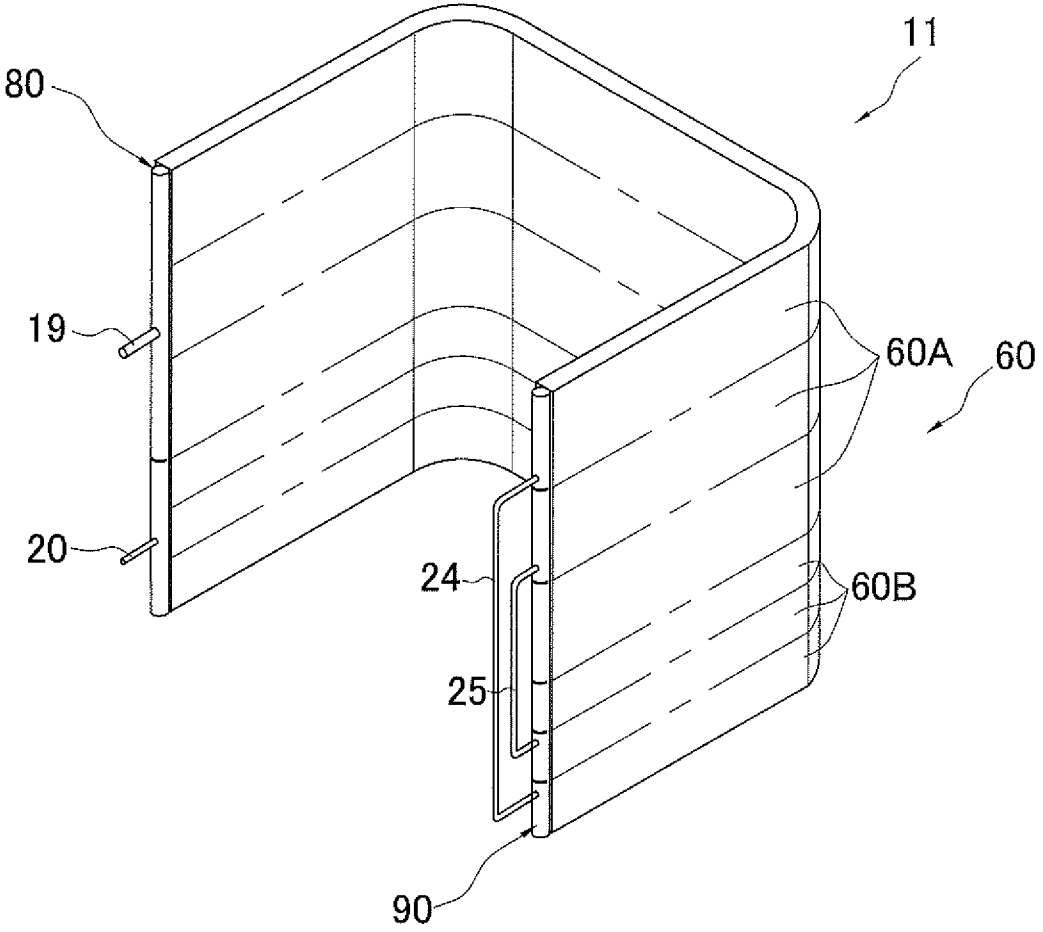
FIG. 3 is a schematic perspective view of an outdoor heat exchanger.
Figure 4:
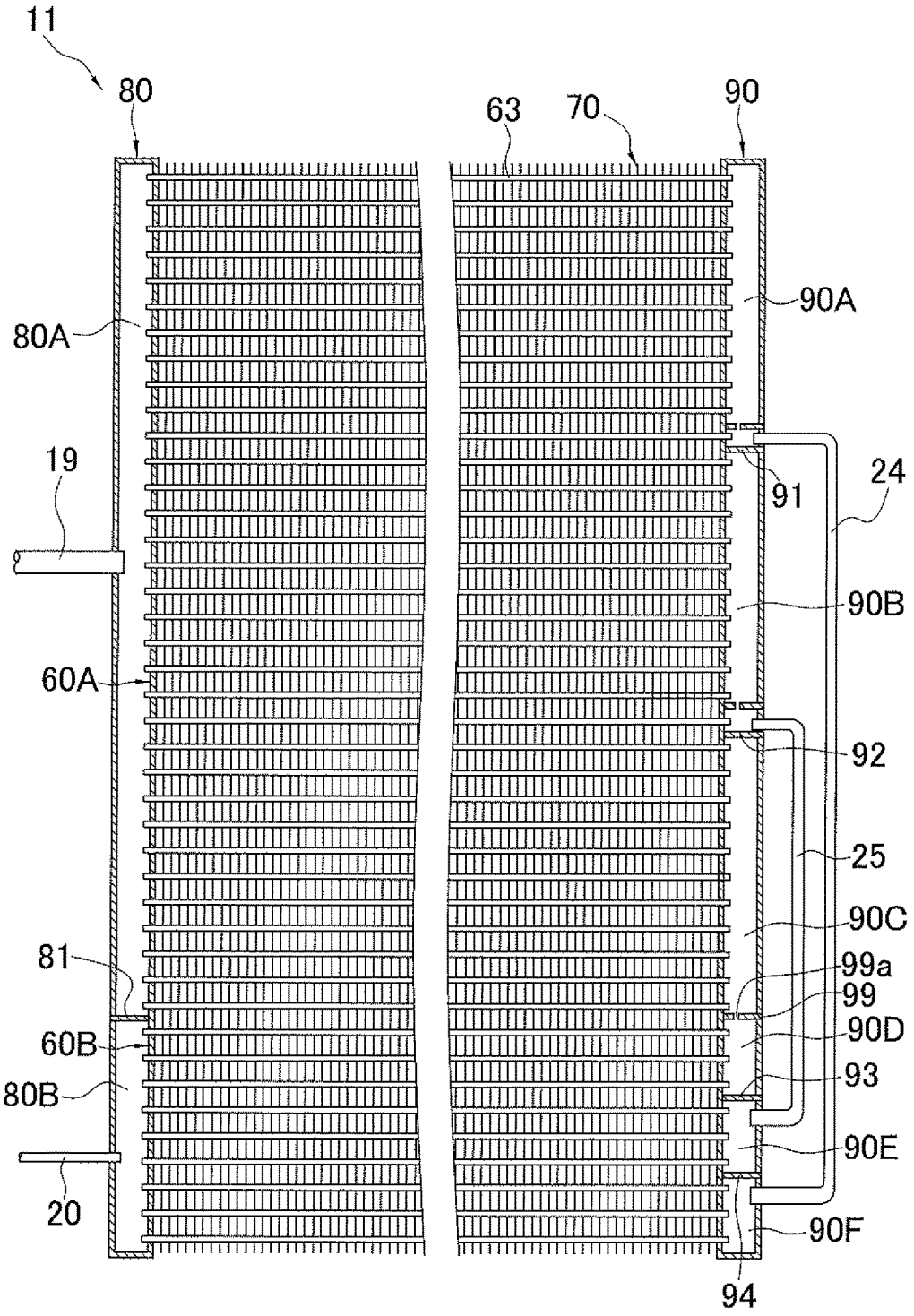
FIG. 4 is a configuration diagram for describing a refrigerant flow of the outdoor heat exchanger.

FIG. 2 is an external perspective view of the outdoor unit 2. FIG. 3 is a schematic perspective view of the outdoor heat exchanger 11. FIG. 4 is a configuration diagram for describing a refrigerant flow of the outdoor heat exchanger 11.

(3-1) Overall Configuration

The outdoor unit 2 is an upward blow-off heat exchange unit that sucks in air from a side surface of a casing 40 and blows out the air from a top surface of the casing 40. The outdoor unit 2 mainly includes the casing 40 having a substantially rectangular parallelepiped shape, the outdoor fan 15 as a fan, and refrigerant circuit components that include components 7, 8, and 11, such as the compressor and the outdoor heat exchanger, the valves 10 and 12 to 14, such as the four-way switching valve and the outdoor expansion valve, and the refrigerant pipes 16 to 22, and configure part of the refrigerant circuit 6. Note that, in the following description, "upper/top/above", "lower/bottom/below", "left", "right", "front", "back", "front surface", and "back surface" mean directions when the outdoor unit 2 in FIG. 2 is viewed from a front (a left oblique front in FIG. 2), unless otherwise specified.

The casing 40 mainly includes a bottom frame 42 that is stretched between a pair of installation legs 41 laterally extending, a support 43 that vertically extends from a corner of the bottom frame 42, a fan module 44 that is attached to an upper end of the support 43, and a front panel 45. Air suction ports 40*a*, 40*b*, and 40*c* are formed on the side surfaces (here, referring to a back surface and both left and right surfaces), and an air blow-out port 40*d* is formed on the top surface.

The bottom frame 42 forms a bottom surface of the casing 40. The outdoor heat exchanger 11 is provided on the bottom frame 42. Here, the outdoor heat exchanger 11 is a heat exchanger having a substantially U-shape in a plan view, facing the back, left, and right surfaces of the casing 40, and substantially forms the back surface and both the left and right surfaces of the casing 40.

The fan module 44 is provided above the outdoor heat exchanger 11. The fan module 44 forms parts of the front, back, left, and right surfaces of the casing 40, above the support 43, and the top surface of the casing 40. Here, the fan module 44 is an assembly where the outdoor fan 15 is accommodated in a box having a substantially rectangular parallelepiped shape with opened top and bottom surfaces. The opening on the top surface of the fan module 44 is the blow-out port 40*d*, which is provided with a blow-out grill 46. The outdoor fan 15 is disposed facing the blow-out port 40*d* in the casing 40. The outdoor fan 15 is a fan that takes in air from the suction ports 40*a*, 40*b*, and 40*c* into the casing 40, and discharges the air from the blow-out port 40*d*.

The front panel 45 is stretched between the supports 43 on the front surface side and forms a front panel of the casing 40.

In addition, the refrigerant circuit components other than the outdoor fan 15 and the outdoor heat exchanger 11 (the accumulator 7, the compressor 8, and the refrigerant pipes 16 to 18 are illustrated in FIG. 2) are also accommodated in the casing 40. Here, the compressor 8 and the accumulator 7 are provided on the bottom frame 42.

As described above, the outdoor unit 2 includes the casing 40 having the air suction ports 40*a*, 40*b*, and 40*c* on the side surfaces (here, the back, left, and right surfaces) and the air blow-out port 40*d* on the top surface, the outdoor fan 15 disposed facing the blow-out port 40*d* in the casing 40, and the outdoor heat exchanger 11 disposed below the outdoor fan 15 in the casing 40.

(3-2) Outdoor Heat Exchanger

The outdoor heat exchanger 11 is a heat exchanger that exchanges heat between the refrigerant and the outdoor air, and mainly includes a first header collection pipe 80, a second header collection pipe 90, the plurality of flat perforated pipes 63, and the plurality of fins 70. Here, the first header collection pipe 80, the second header collection pipe 90, the flat perforated pipes 63, and the fins 70 are all formed of aluminum or aluminum alloy, and joined by, for example, brazing.

Note that detailed configurations of the flat perforated pipe 63 and the fin 70 will be described later.

The first header collection pipe 80 and the second header collection pipe 90 are both members having an elongated hollow cylindrical shape. The first header collection pipe 80 is vertically provided on one end side of the outdoor heat exchanger 11 (here, on a left front end side in FIG. 3), while the second header collection pipe 90 is vertically provided on the other end side (here, on a right front end side in FIG. 3) of the outdoor heat exchanger 11.

As illustrated in FIG. 3, the outdoor heat exchanger 11 includes the heat exchange section 60 that is configured by fixing the fins 70 to the plurality of flat perforated pipes 63 that are vertically arranged. The heat exchange section 60 includes an upper heat exchange section 60A on an upper stage and a lower heat exchange section 60B on a lower stage.

As illustrated in FIG. 4, the first header collection pipe 80 is vertically partitioned by a partition plate 81 having an internal space that horizontally extends to form a gas side inlet and outlet communication space 80A and a liquid side inlet and outlet communication space 80B. The flat perforated pipes 63 that configure the corresponding upper heat exchange section 60A communicate with the gas side inlet and outlet communication space 80A. The flat perforated pipes 63 that configure the corresponding lower heat exchange section 60B communicate with the liquid side inlet and outlet communication space 80B.

The refrigerant pipe 19 (see FIG. 1) communicates with the gas side inlet and outlet communication space 80A of the first header collection pipe 80. The refrigerant pipe 19 sends the refrigerant sent from the compressor 8 during the cooling operation, to the gas side inlet and outlet communication space 80A.

The refrigerant pipe 20 (see FIG. 1) communicates with the liquid side inlet and outlet communication space 80B of the first header collection pipe 80. The refrigerant pipe 20 sends the refrigerant sent from the outdoor expansion valve 12 during the heating operation, to the liquid side inlet and outlet communication space 80B.

An internal space of the second header collection pipe 90 is vertically partitioned by, from top to bottom, partition plates 91, 92, 93, and 94 that horizontally extend, while the internal space is vertically divided by a partition plate 99 with a nozzle provided between the partition plates 92 and 93. Thus, first to third upper return communication spaces 90A, 90B, and 90C, and first to third lower return communication spaces 90D, 90E, and 90F are formed. The flat perforated pipes 63 in the corresponding upper heat exchange section 60A communicate with the first to third upper return communication spaces 90A, 90B, and 90C, and the flat perforated pipes 63 in the corresponding lower heat exchange section 60B communicate with the first to third lower return communication spaces 90D, 90E, and 90F. The third upper return communication space 90C and the first lower return communication space 90D are vertically divided by the partition plate 99 with the nozzle, but vertically communicate with each other via a nozzle 99*a* that is provided so as to vertically pass through the partition plate 99 with the nozzle. Further, the first upper return communication space 90A and the third lower return communication space 90F are connected to each other via a first connection pipe 24 that is connected to the second header collection pipe 90. The second upper return communication space 90B and the second lower return communication space 90E are connected to each other via a second connection pipe 25 that is connected to the second header collection pipe 90.

In this configuration, when the outdoor heat exchanger 11 functions as an evaporator of the refrigerant, the refrigerant that has flowed from the refrigerant pipe 20 into the liquid side inlet and outlet communication space 80B of the first header collection pipe 80 flows into the flat perforated pipes 63 of the lower heat exchange section 60B connected to the liquid side inlet and outlet communication space 80B, and then flows into the first to third lower return communication spaces 90D, 90E, and 90F of the second header collection pipe 90. The refrigerant that has flowed into the first lower return communication space 90D flows into the third upper return communication space 90C via the nozzle 99*a* of the partition plate 99 with the nozzle, and flows into the gas side inlet and outlet communication space 80A of the first header collection pipe 80 via the flat perforated pipes 63 of the upper heat exchange section 60A that is connected to the third upper return communication space 90C. The refrigerant that has flowed into the second lower return communication space 90E flows into the second upper return communication space 90B via the second connection pipe 25, and flows into the gas side inlet and outlet communication space 80A of the first header collection pipe 80 via the flat perforated pipes 63 of the upper heat exchange section 60A that is connected to the second upper return communication space 90B. The refrigerant that has flowed into the third lower return communication space 90F flows into the first upper return communication space 90A via the first connection pipe 24, and flows into the gas side inlet and outlet communication space 80A of the first header collection pipe 80 via the flat perforated pipes 63 of the upper heat exchange section 60A that is connected to the first upper return communication space 90A. The refrigerant that has joined in the gas side inlet and outlet communication space 80A of the first header collection pipe 80 flows outside of the outdoor heat exchanger 11 via the refrigerant pipe 19.

Note that when the outdoor heat exchanger 11 is used as a radiator of the refrigerant, the refrigerant flows inversely to the above.

(4) Flat Perforated Pipe

Figure 5:
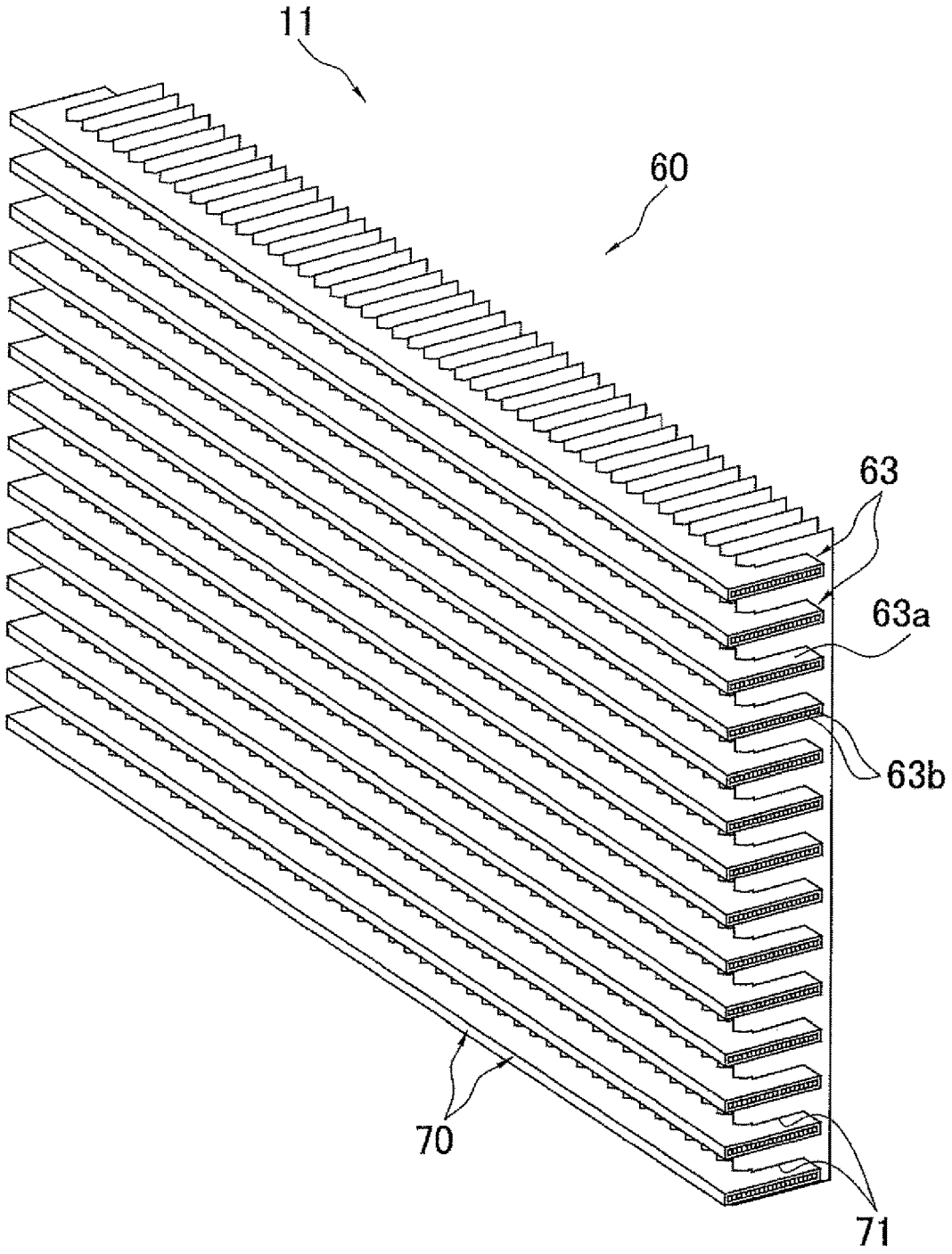
FIG. 5 is an enlarged partial view of a heat exchange section of FIG. 3.
Figure 6:
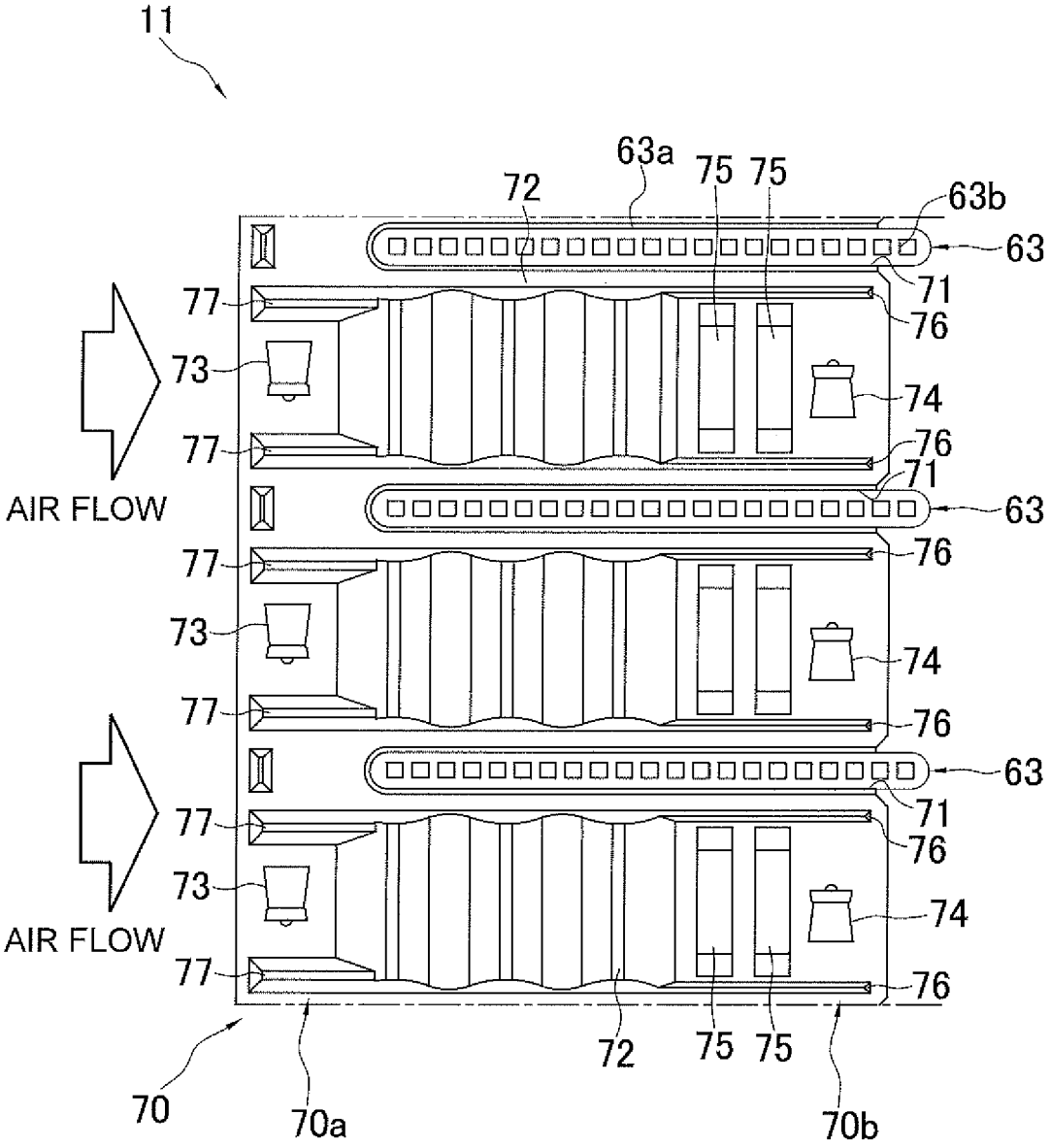
FIG. 6 is a diagram illustrating a fin being attached to flat perforated pipes as viewed from a longitudinal direction of the flat perforated pipes 63.

FIG. 5 is an enlarged partial view of the heat exchange section 60 of FIG. 3. FIG. 6 illustrates the fin 70 being attached to the flat perforated pipes 63 as viewed from the longitudinal direction of the flat perforated pipes 63.

The flat perforated pipe 63 includes the flat surfaces 63*a* that are upper and lower surfaces facing in the vertical direction and being heat transfer surfaces, and a large number of small passages 63*b* in which the refrigerant flows. The plurality of passages 63*b* included in the flat perforated pipe 63 is aligned in an air flow direction (a longitudinal direction of the passage 63*b* in a cross-sectional view).

Note that the flat perforated pipe 63 is manufactured, though not limited, for example, by extrusion molding.

The plurality of flat perforated pipes 63 is vertically aligned at predetermined intervals.

Both ends of each passage 63*b* of the flat perforated pipes 63 are connected to the first header collection pipe 80 and the second header collection pipe 90, respectively.

The outdoor heat exchanger 11 according to one or more embodiments is configured in such a manner that a downstream side end part of the plurality of the flat perforated pipes 63 in the air flow direction is located further on the downstream side with respect to a downstream side end part of the fin 70 in the air flow direction. This allows the outdoor heat exchanger 11 to have a configuration where not the fin 70 but part of the flat perforated pipe 63 is exposed to the leeward side. Damage and breakage of a leeward side end part of the fin 70 during manufacture or transportation of the outdoor heat exchanger 11 can be thus suppressed. When the outdoor heat exchanger 11 is bent with a tool, such as a roller, the bending can be done with the tool pressed not to the fin 70 but to the flat perforated pipe 63, and thus deformation of or damage to the fin 70 can be suppressed. Further, when the outdoor heat exchanger 11 is brazed in a furnace, the outdoor heat exchanger 11 can be brazed while not the fin 70 but the flat perforated pipe 63 is grounded. This can suppress deformation of the aluminum fin 70 caused by possible thermal expansion or contraction of the fin 70 due to contact of the fin 70 with a furnace floor during brazing.

(5) Fin

Figure 7:
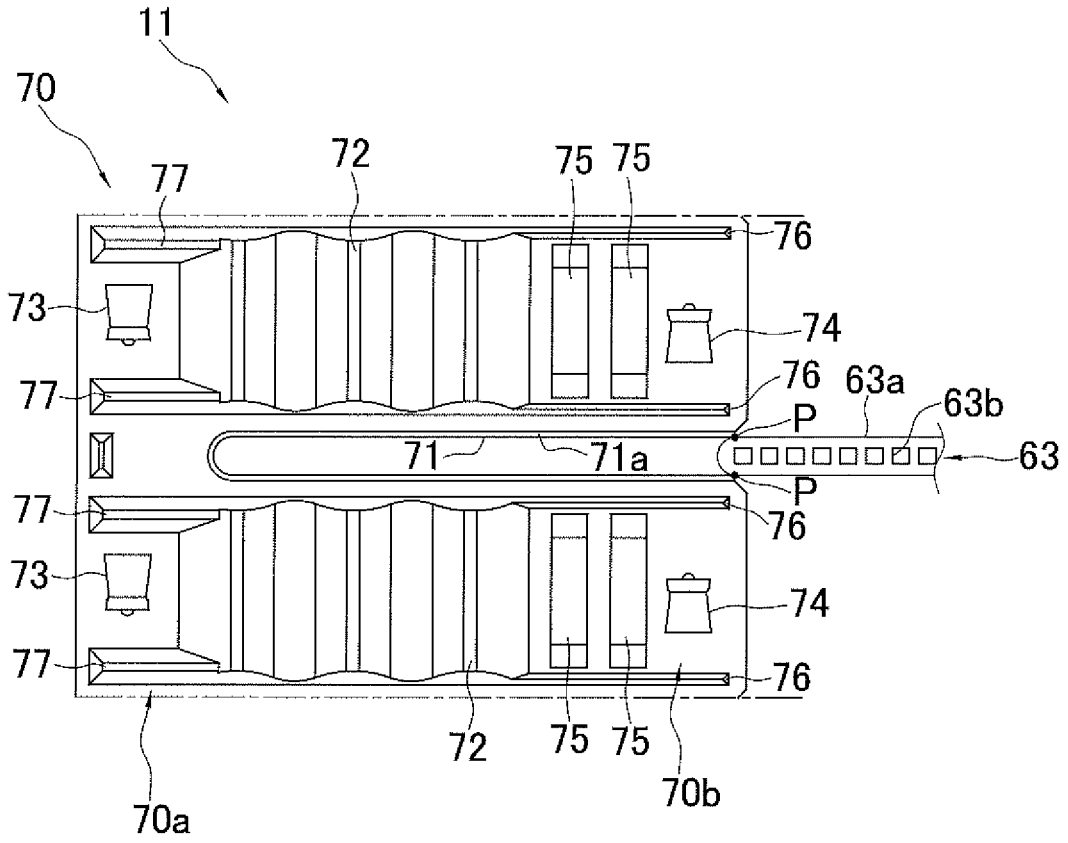
FIG. 7 is a diagram illustrating one of the flat perforated pipes being inserted into the fin.

FIG. 7 illustrates the flat perforated pipe 63 being inserted into the fin 70.

The fin 70 is a plate-shaped member that extends in the air flow direction and in the vertical direction. A plurality of the fins 70 is disposed at predetermined intervals in the thickness direction, and fixed to the flat perforated pipes 63.

On the fin 70, a plurality of insertion parts 71 horizontally cut from a leeward side edge part toward a windward side up to near a windward side edge part is formed so as to be arranged vertically. Note that the insertion part 71 is configured as an edge part of the fin collar 71*a* formed by, for example, burring on a side of the flat perforated pipe 63. The form of this insertion part 71 is substantially identical to an external shape of a cross-section of the flat perforated pipe 63. The flat perforated pipe 63 is inserted into the insertion part 71 and fixed to each other by brazing.

Figure 8:
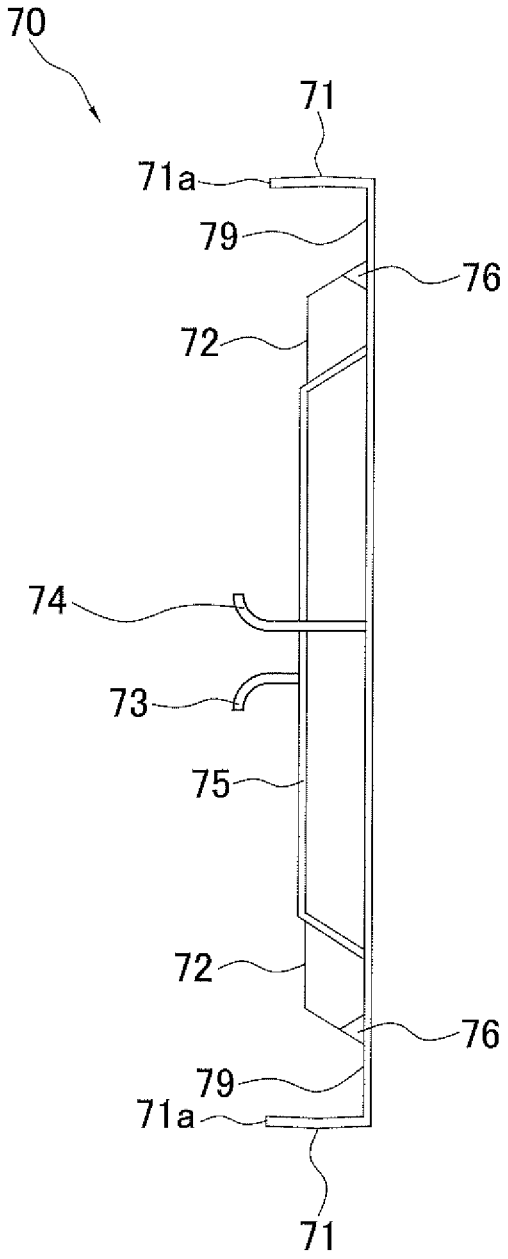
FIG. 8 is a diagram illustrating a form of the fin viewed from an insertion direction of the flat perforated pipe.
Figure 9:
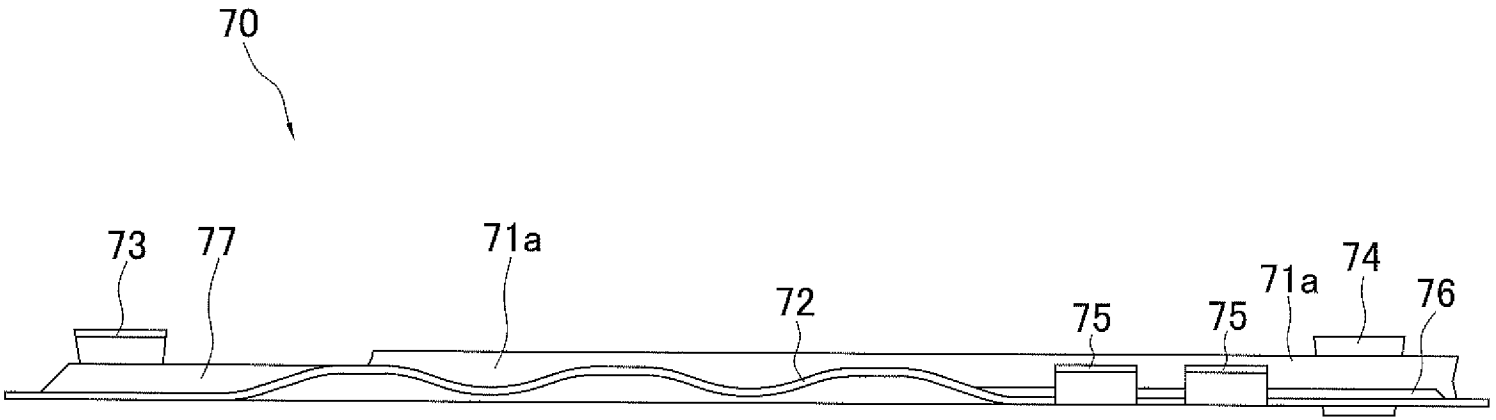
FIG. 9 is a diagram illustrating the form of the fin viewed from a direction perpendicular to both the insertion direction of the flat perforated pipe and the thickness direction of the fin.

The fin 70 includes a communication part 70*a* that vertically continues further on the windward side with respect to the windward side end part of the flat perforated pipe 63, and a plurality of leeward parts 70*b* that extends from the communication part 70*a* to the downstream side of the air flow direction. Here, a distance from a windward end of the flat perforated pipe 63 to a windward end of the communication part 70*a* of the fin 70 in the air flow direction is preferably 4 mm or longer to ensure frost proof strength. Note that the leeward part 70*b* is a part that is vertically surrounded by the insertion parts 71 adjacent to each other. FIG. 8 illustrates the form of the fin 70 as viewed from the insertion direction of the flat perforated pipe 63. FIG. 9 illustrates the form of the fin 70 as viewed from the direction perpendicular to both the insertion direction of the flat perforated pipe 63 and the thickness direction of the fin 70.

As illustrated in FIGS. 6 to 9, in addition to the above insertion part 71, the fin 70 includes a waffle part 72, a communication side fin tab 73, an insertion side fin tab 74, the slit 75, an insertion side rib 76, a communication side rib 77, a main surface 79, and others. Note that a thickness of the main surface 79 in a thickness direction is, for example, from 0.05 mm to 0.15 mm inclusive.

The insertion part 71 extends in the insertion direction, which is a direction that crosses the direction along which the flat perforated pipes 63 are arranged and the longitudinal direction of the flat perforated pipe 63. A length of the insertion part 71 in the insertion direction is shorter than a length of the flat perforated pipe 63 in the insertion direction, and only part of the flat perforated pipe 63 is inserted. The insertion part 71 is configured as part of the fin collar 71*a* on the side of the flat perforated pipe 63. The fin collar 71*a* is vertically provided with respect to the main surface 79 of the fin 70 so as to be opposed to a periphery including the flat surface 63*a* of the flat perforated pipe 63. A height of the fin collar 71*a* in a direction perpendicular to the main surface 79 is not limited but may be, for example, higher than a height of the slit 75 or the waffle part 72 described later. A width of the insertion part 71 substantially corresponds to a width of the flat perforated pipe 63. When the flat perforated pipe 63 is inserted, a friction is caused between the flat surface 63*a* of the flat perforated pipe 63 and the insertion part 71. The flat perforated pipe 63 that has been thus inserted into the insertion part 71 of the fin 70 is fixed to the fin 70 by brazing.

The waffle part 72 is formed between the insertion parts 71 adjacent to each other (between the fin collars 71*a* adjacent to each other) and near a center in the air flow direction. The waffle part 72 is formed in the air flow direction by alternately repeating a part that rises and a part that does not rise in a thickness direction, and the part that rises and the part that does not rise vertically continue. The waffle part 72 is formed in a region that stretches from near the center in the air flow direction of the leeward part 70*b* of the fin 70 to the communication part 70*a* of the fin 70.

The communication side fin tab 73 is formed on the upstream side of the air flow direction of the waffle parts 72 in the communication part 70*a* of the fin 70 to regulate, on the windward side, a distance between the fins 70 aligned in the thickness direction. The communication side fin tab 73 maintains a distance in the thickness direction near the communication part 70*a* of the fins 70 adjacent to each other by the fin 70 being partially cut and raised.

The insertion side fin tab 74 is formed near the downstream side end part of the air flow direction of the leeward part 70*b* of the fin 70 to regulate, on the leeward side, the distance between the fins 70 aligned in the thickness direction. Similar to the communication side fin tab 73, the insertion side fin tab 74 maintains the distance in the thickness direction near the leeward side end part of the fins 70 that are adjacent to each other by the fin 70 being partially cut and raised.

The slit 75 is a part that is cut and raised from the main surface 79 in the thickness direction to enhance the heat transfer performance in the fin 70, and is formed on the downstream side of the air flow direction of the waffle part 72 in the leeward part 70*b* of the fin 70. Specifically, in one or more embodiments, the slit 75 is formed between the insertion parts 71 adjacent to each other (specifically, between the fin collars 71*a*) in such a manner that the longitudinal direction of the slit 75 is the vertical direction (an arrangement direction of the flat perforated pipe 63) between the waffle part 72 and the insertion side fin tab 74. A plurality (two in one or more embodiments) of the slits 75 is aligned along the air flow direction. As illustrated in FIG. 8, the slit 75 includes openings that are formed on both the windward and leeward sides by being cut and raised from the main surface 79 of the fin 70 to the same side in the thickness direction. A cutting and raising height of the slit 75 (a height in the thickness direction) is from 40% to 60% of the distance (fin pitch) between the fins 70 adjacent to each other to enhance the heat transfer performance, preferably from 45% to 55%, and most preferably half of the fin pitch. Since a length of the communication side fin tab 73 or the insertion side fin tab 74 in the thickness direction of the main surface 79 defines the fin pitch, the cutting and raising height of the slit 75 is preferably about half of the length of the communication side fin tab 73 or the insertion side fin tab 74. In one or more embodiments, a part of the waffle part 72 that rises most is located at about half of the fin pitch. Further, a width of the slit 75 in the vertical direction (a direction along which the flat perforated pipes 63 are arranged) is shorter than a width of the waffle part 72 in the vertical direction. In one or more embodiments, the two slits 75 are aligned in the air flow direction. For example, a distance between the slits 75 in the air flow direction may be equal to or shorter than the width of one of the slits 75.

The insertion side rib 76 extends in such a manner that the insertion direction of the flat perforated pipe 63 is the longitudinal direction of the insertion side rib 76 between the insertion part 71 (specifically, fin collar 71*a*) and the slit 75. The insertion side ribs 76 are provided on both sides of the slit 75 in the vertical direction (the direction along which the flat perforated pipes 63 are arranged). As illustrated in FIG. 7, the insertion side rib 76 linearly extends in parallel to the insertion direction toward the insertion advancing side in the insertion direction with respect to a contact part P that the flat perforated pipe 63 first touches when the flat perforated pipe 63 is inserted into the insertion part 71 of the fin 70. The insertion side rib 76 continuously extends so as to stretch across all the slits 75 in the insertion direction of the flat perforated pipe 63, and extends further on the windward side with respect to the slit 75 that is located on the most windward side. Specifically, the insertion side rib 76 stretches across all the slits 75 from the downstream side with respect to the insertion side fin tab 74 in the insertion direction of the flat perforated pipe 63, and continuously extends in the insertion direction to reach further the windward side with respect to the slit 75 that is located on the most windward side.

In one or more embodiments, the insertion side rib 76 is separated from both the slit 75 and the fin collar 71*a*. The closest distance between the insertion side rib 76 and the slit 75 is shorter than the closest distance between the insertion side rib 76 and the fin collar 71*a*.

As illustrated in FIG. 7, the insertion side rib 76 is formed by the main surface 79 of the fin 70 being raised in the thickness direction. That is, the insertion side rib 76 includes the part that rises from the main surface 79 of the fin 70 until reaching the top part, the top part, and the part that falls from the top part to the main surface 79. Here, the width of the insertion side rib 76 in a direction perpendicular to the longitudinal direction of the insertion side rib 76 on the main surface 79 of the fin 70 is not limited to but preferably 0.3 mm or wider, and more preferably 0.5 mm or wider to reliably suppress the buckling of the fin 70. The above width is preferably 2.0 mm or narrower and more preferably 1.0 mm or narrower to readily ensure the length of the slit 75 in the longitudinal direction for enhancing the heat transfer performance of the fin 70. The rising height of the insertion side rib 76 may be half of the height of the slit 75 or lower, preferably 1.0 mm or lower, and more preferably 0.5 mm or lower.

The edge part of the insertion side rib 76 on the side of the fin collar 71*a* continues in the insertion direction to the edge part of the waffle part 72 on the side of the fin collar 71*a*, the waffle part 72 being located further on the windward side.

The communication side rib 77 extends in the insertion direction both above and below the communication side fin tab 73 (on both one side and the other side of the arrangement direction of the flat perforated pipes 63). The edge part of the communication side rib 77 on the side opposite to the communication side fin tab 73 continues in the insertion direction to the edge part of the insertion side rib 76 on the side of the fin collar 71*a*, and to the edge part of the waffle part 72 on the side of the fin collar 71*a*. Further, the slit 75 is not formed in a part where the communication side rib 77 is provided in the insertion direction. A vertical width of the communication side rib 77 is wider than a vertical width of the insertion side rib 76.

(6) Characteristics (6-1)

The outdoor heat exchanger 11 according to one or more embodiments is manufactured by inserting the flat perforated pipe 63 into the insertion part 71 of the fin 70 and fixing the flat perforated pipe 63 by brazing. Here, since the insertion part 71 of the fin 70 is formed in a shape that corresponds to an external edge of the flat perforated pipe 63, the insertion part 71 of the fin 70 causes friction with the flat surface 63*a* of the flat perforated pipe 63 at the time of the insertion of the flat perforated pipe 63, and the stress is applied to the insertion part 71. In particular, since the fin collar 71*a* is formed on the fin 70 according to one or more embodiments, an area where the friction is caused with the flat surface 63*a* of the flat perforated pipe 63 is wide, and the great stress is easily applied to the fin 70. Since the slit 75 including a cut-and-raised part is formed on the fin 70 to enhance the heat transfer performance, the edge part of the slit 75, particularly, a part of the edge part near the insertion part 71 has low strength. When the stress concentrates on this part, the fin 70 may buckle with the part as an initiating point.

However, in the outdoor heat exchanger 11 according to one or more embodiments, the insertion side rib 76 is formed between the insertion part 71 of the fin 70 and the slit 75. This can relax the stress concentration on the fin 70 near the slit 75 at the time of the insertion of the flat perforated pipe 63, and suppress the buckling of the fin 70 with the vicinity of the slit 75 as the initiating point of the buckling.

(6-2)

As illustrated in FIG. 7, when the flat perforated pipe 63 is inserted into the fin 70, the stress toward the insertion advancing side is easily caused with the contact part P of the insertion part 71 of the fin 70 as the initiating point, the contact part P being touched by the flat perforated pipe 63 first.

To address this issue, in the outdoor heat exchanger 11 according to one or more embodiments, the insertion side rib 76 on the fin 70 is formed further on the insertion direction advancing side with respect to the contact part P that the flat perforated pipe 63 first touches. Therefore, the stress to the fin 70 at the contact part P is released along the insertion side rib 76 to the insertion direction advancing side. This can relax the stress concentration on the fin 70 near the edge part of the slit 75.

In particular, the insertion side rib 76 continuously extends so as to stretch across all the plurality of slits 75 aligned in the air flow direction in the fin 70. Therefore, the stress concentration on the external edge of any of the slits 75 provided on the fin 70 can be suppressed.

Further, the insertion side ribs 76 are provided on both sides of the slits 75 in the vertical direction (the arrangement direction of the flat perforated pipes 63). This can suppress the buckling in the edge parts of the slits 75.

(6-3)

In the outdoor heat exchanger 11 according to one or more embodiments, the cutting and raising height (the height in the thickness direction) of the slit 75 is from 40% to 60% of the distance (fin pitch) between the fins 70 adjacent to each other. As a result, the air flow that passes near the center between the fins 70 adjacent to each other at the highest flow speed can be applied to the slit 75, and the cutting and raising height can be readily ensured. The heat transfer performance can be thus enhanced.

Here, in the outdoor heat exchanger 11 according to one or more embodiments, as illustrated in FIG. 8, the insertion side rib 76 rises from the main surface 79 of the fin 70 to reach the top part, and falls to reach the main surface 79 again so as to be raised from the fin collar 71*a* side toward the slit 75 side. This slit 75 is thus directly cut and raised from the main surface 79 toward one side of the thickness direction. Specifically, when a raised surface that is raised from the main surface 79 to the one side of the thickness direction is formed, the slit 75 is not cut and raised from the raised surface further toward the one side of the thickness direction.

As a result, the distance between the main surfaces 79 of the fins 70 adjacent to each other (particularly, the distance between the main surfaces 79 around the slit 75) is secured wide. Thus, when the slit 75 is cut and raised to around a middle of the height position of this distance, the cutting and raising height of the slit 75 is secured high enough (the cutting and raising height is secured high enough compared with a case where the slit 75 is cut and raised to around a middle height between the raised surface and the adjacent fin 70). This can enhance the heat transfer performance of the fin 70.

(7) Modifications

Although one or more exemplary embodiments have been described above, these exemplary embodiments are not intended to limit the present invention. The present invention naturally includes embodiments that are appropriately modified within the scope of the disclosure.

(7-1) Modification A

In one or more embodiments, the configuration where the leeward side end part of the flat perforated pipe 63 protrudes further to the leeward side with respect to the leeward part 70*b* of the fin 70 has been described by way of example.

Figure 10:
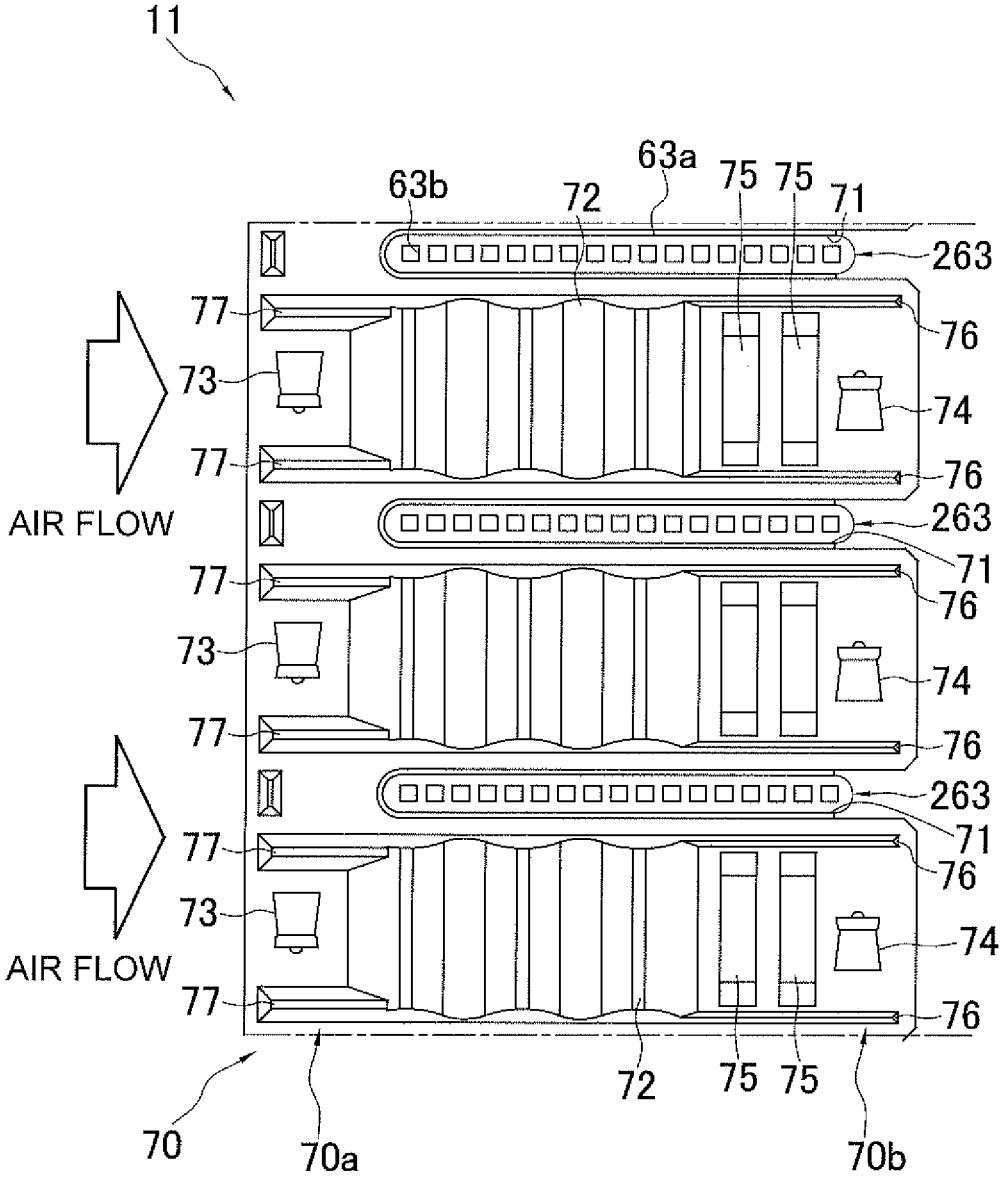
FIG. 10 is a diagram illustrating a fin of a heat exchanger according to Modification A, being attached to flat perforated pipes.

However, a relationship between the width of the insertion part 71 of the fin 70 and the width of the flat perforated pipe 63 in the air flow direction is not limited to this relationship. For example, as illustrated in FIG. 10, the heat exchanger may be configured as the leeward side end part of the leeward part 70*b* of the fin 70 protrudes further to the leeward side with respect to the leeward side end part of the flat perforated pipe 63.

(7-2) Modification B

In one or more embodiments, a case where the two slits 75 are aligned on the fin 70 in the air flow direction has been described by way of example.

Figure 11:
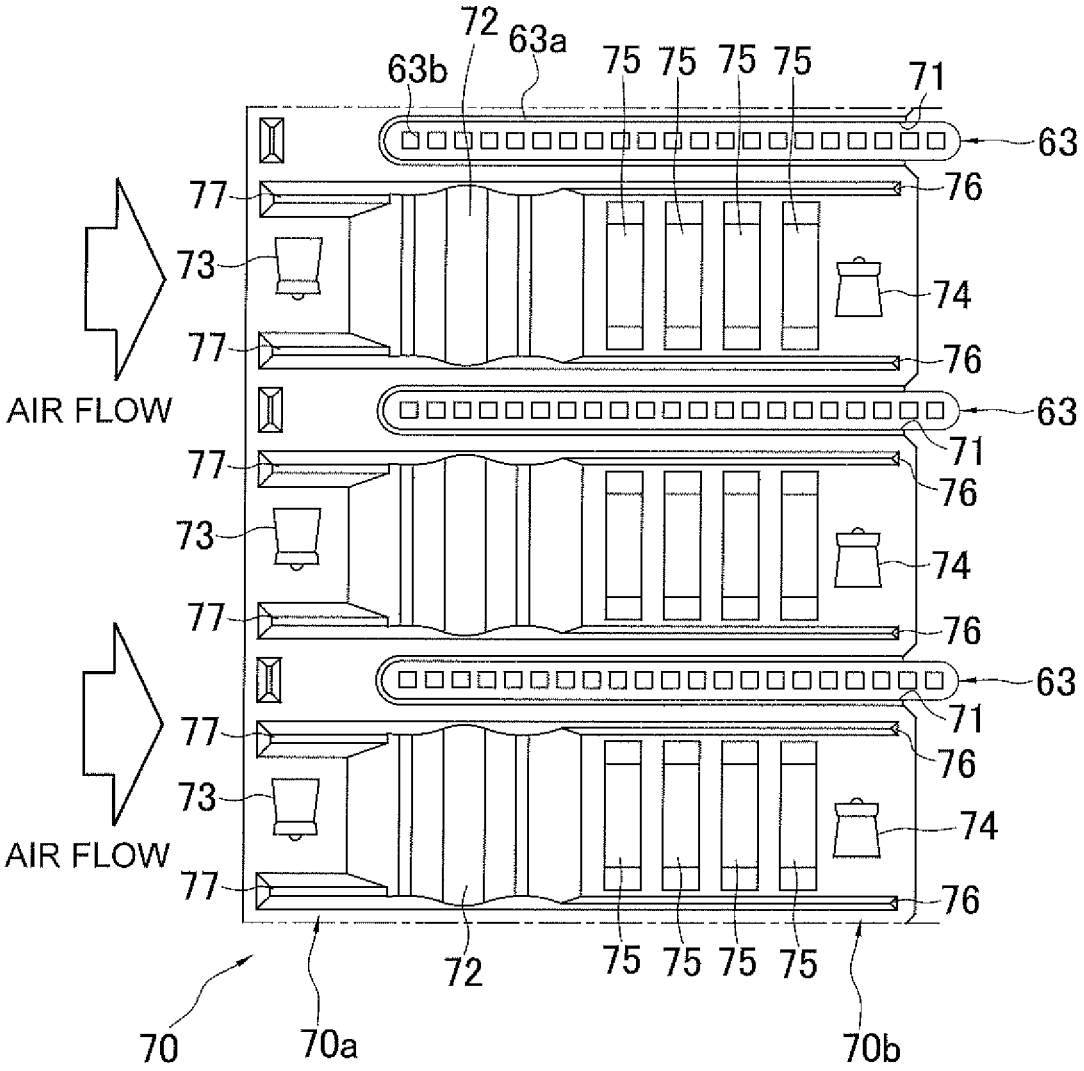
FIG. 11 is a diagram illustrating a fin of a heat exchanger according to Modification B, being attached to flat perforated pipes.

However, the number of the slits 75 provided on the fin 70 is not limited to this. For, example, as illustrated in FIG. 11, four slits 75 may be aligned in the air flow direction. Providing more slits 75 will thus further enhance the heat transfer performance of the fin 70. In this case, a length of the waffle part 72 in the air flow direction becomes shorter for an increase in the number of the slits 75, compared with the fin 70 of one or more embodiments. In this modification, since the insertion side rib 76 continuously stretches across all the four slits 75 in the insertion direction, the buckling of the edge parts of the slits 75 can be suppressed. From what has been confirmed by an analysis, when the insertion side rib 76 stretches across the slits 75 in the insertion direction of the flat perforated pipe 63, an increased number of slits 75 provided in the fin 70 does not reduce the strength of the fin 70, and the buckling at the time of the insertion can be suppressed.

(7-3) Modification C

In one or more embodiments, a case where the two slits 75 and the waffle part 72 are aligned in the air flow direction on the fin 70 has been described by way of example.

Figure 12:
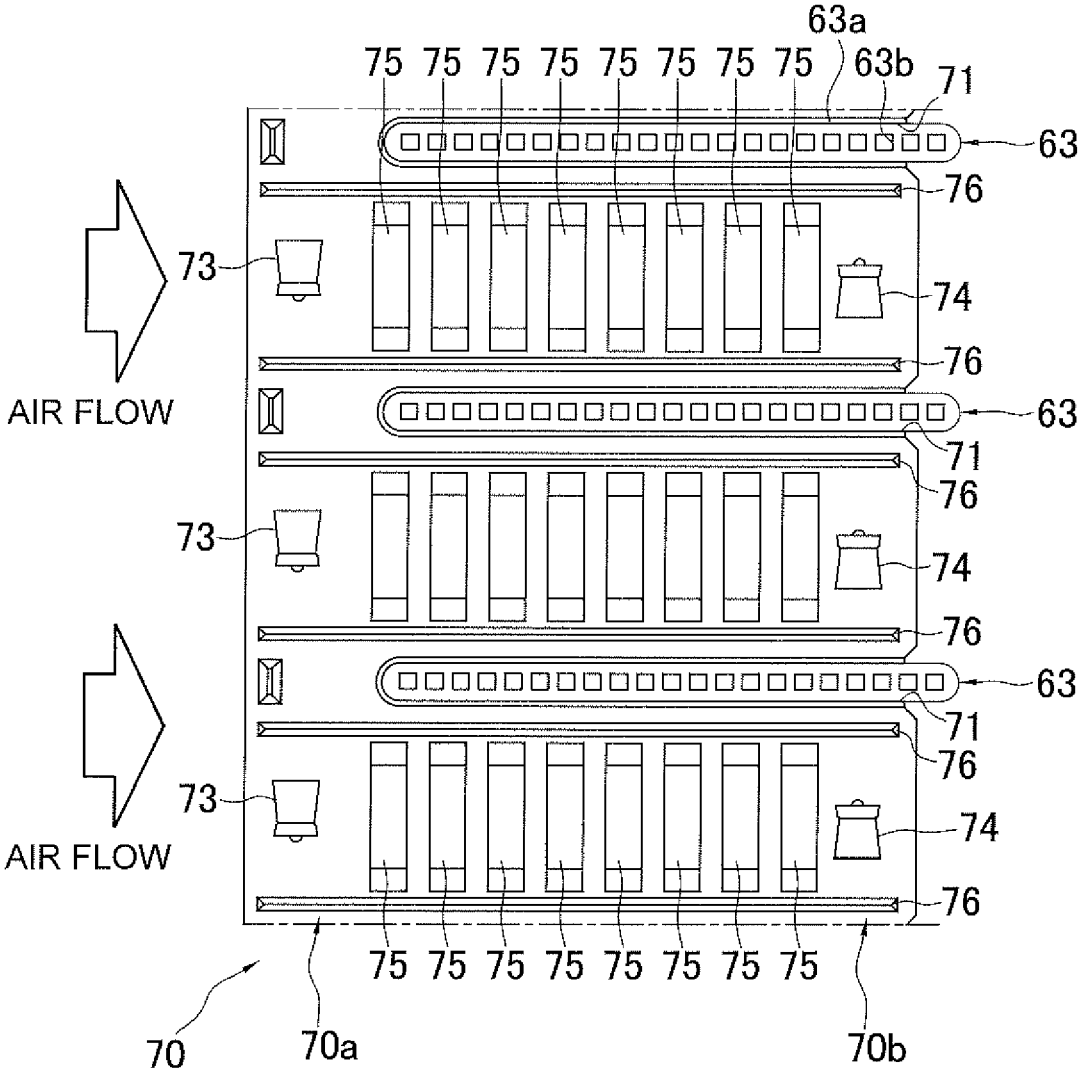
FIG. 12 is a diagram illustrating a fin of a heat exchanger according to Modification C, being attached to flat perforated pipes.

Alternatively, for example, as illustrated in FIG. 12, the fin 70 having additional slits 75 instead of the waffle part 72 (having eight slits 75 aligned in the air flow direction) may be used. In this case, the insertion side rib 76 according to one or more embodiments may be extended to the upstream side of the air flow direction, and may be stretched across all the slits 75 in the insertion direction.

(7-4) Modification D

In the outdoor heat exchanger 11 according to one or more embodiments, as the cut-and-raised part formed on the fin 70, the slit 75 that is provided with the openings on the same side in the thickness direction on both the upstream and downstream sides of the air flow direction has been described by way of example.

However, the cut-and-raised part formed on the fin 70 is not limited as long as being able to enhance the heat transfer performance. For example, a louver may be used that is opened only on the windward side but not on the leeward side and that smoothly continues to the main surface 79.

Alternatively, an inclined slit may be used that is formed in such a manner that a part that is cut and raised, as the cut-and-raised part formed on the fin 70, with respect to the main surface 79 is inclined, the opening is created on one side of the main surface 79 on the windward side, and another opening is created on the opposite side of the main surface 79 on the leeward side.

Since the insertion side rib 76 is formed on any of the edge parts, the buckling at the time of the insertion of the flat perforated pipe 63 can be suppressed.

(7-5) Modification E

In the outdoor heat exchanger 11 according to one or more embodiments, the insertion side rib 76 that linearly extends in the insertion direction between the slit 75 and the insertion part 71 of the fin 70 has been described by way of example.

However, the insertion side rib 76 provided between the slit 75 and the insertion part 71 of the fin 70 is not limited to the rib that linearly extends in the insertion direction. For example, the insertion side rib 76 to be used may obliquely extend so as to approach the slit 75 or to shift away from the slit 75 toward the insertion advancing direction. Further, the insertion side rib 76 does not need to linearly extend, but for example, may meander in such a manner that the insertion direction is the longitudinal direction.

REFERENCE SIGNS LIST

1 Air conditioner
2 Outdoor unit
11 Outdoor heat exchanger (heat exchanger)
63 Flat perforated pipe (flat pipe)
63*a* Flat surface
63*b* Passage
70 Fin
70*a* Communication part
70*b* Leeward part
71 Insertion part
71*a* Fin collar
72 Waffle part
73 Communication side fin tab
74 Insertion side fin tab
75 Slit (cut-and-raised part)
76 Insertion side rib (rib)
77 Communication side rib Although the disclosure has been described with respect to only a limited member of embodiments, those skilled in the art, having benefit of this disclosure, will appreciate that various other embodiments may be devised without departing from the scope of the present invention. Accordingly, the scope of the invention should be limited only by the attached claims.

The invention claimed is:

1. A heat exchanger comprising:
flat pipes arranged such that flat surfaces of the flat pipes are opposed to one another; and
fins each including:
insertion parts that extend in an insertion direction that is substantially perpendicular to:
a direction of arrangement of the flat pipes, and
a longitudinal direction of the flat pipes, wherein
at least part of each of the flat pipes is inserted into a corresponding one of the insertion parts;
cut-and-raised parts that are each disposed between adjacent ones of the insertion parts and raised from a main surface of each of the fins in a thickness direction of each of the fins; and
a rib disposed between one of the insertion parts and one of the cut-and-raised parts, wherein
the cut-and-raised parts are aligned in the insertion direction of the flat pipes,
for each of the fins, the rib extends along the insertion direction of the flat pipes, and
for each of the fins, the rib continuously extends further to an insertion advancing side with respect to one of the cut-and-raised parts disposed furthest on the insertion advancing side in the insertion direction of the flat pipes.

2. The heat exchanger according to claim 1, wherein
for each of the fins, the rib is disposed on the insertion advancing side in the insertion direction with respect to a contact part of one of the insertion parts, and
the contact part contacts the flat pipes first when the flat pipes are inserted into the fins.

3. The heat exchanger according to claim 1, wherein
each of the fins further includes a fin collar that fringes one of the insertion parts and opposes the flat surfaces of the flat pipes, and
for each of the fins, the rib is disposed between the fin collar and one of the cut-and-raised parts.

4. The heat exchanger according to claim 1, wherein
each of the fins further includes another rib, and
for each of the fins:
one of the ribs is disposed between a first side of one of the cut-and-raised parts and one of the insertion parts, and
another of the ribs is disposed between a second side of the one of the cut-and-raised parts and another of the insertion parts.

5. The heat exchanger according to claim 1,
wherein the rib is disposed by raising a part of the fins in the thickness direction.

6. A heat exchanger comprising:
flat pipes arranged such that flat surfaces of the flat pipes are opposed to one another; and
fins each including:
insertion parts that extend in an insertion direction that crosses a direction in which the flat pipes are disposed and a longitudinal direction of the flat pipes, wherein
at least part of each of the flat pipes is inserted into a corresponding one of the insertion parts;

a first cut-and-raised part that is cut and raised in a thickness direction between adjacent ones of the insertion parts; and a rib disposed between one of the insertion parts and the first cut-and-raised part, wherein each of the fins further includes a fin collar that fringes one of the insertion parts and opposes the flat surfaces of the flat pipes, and for each of the fins, the rib is disposed between the fin collar and the first cut-and-raised part.

7. The heat exchanger according to claim 6, wherein for each of the fins, the rib is disposed on an insertion advancing side in the insertion direction with respect to a contact part of one of the insertion parts, and the contact part contacts the flat pipes first when the flat pipes are inserted into the fins.

8. The heat exchanger according to claim 6, wherein each of the fins further includes a second cut-and-raised part, the first and second cut-and-raised parts are aligned in the insertion direction of the flat pipes, and for each of the fins, the rib extends along the insertion direction of the flat pipes between one of the insertion parts and one of the first or second cut-and-raised part.

9. The heat exchanger according to claim 8, wherein for each of the fins, the rib continuously extends further to an insertion advancing side with respect to one of the first or second cut-and-raised part disposed furthest on the insertion advancing side in the insertion direction of the flat pipes.

10. The heat exchanger according to claim 6, wherein each of the fins further includes another rib, and for each of the fins:

one of the ribs is disposed between a first side of the first cut-and-raised part and one of the insertion parts, and another of the ribs is disposed between a second side of the first cut-and-raised part and another of the insertion parts.

11. The heat exchanger according to claim 6, wherein the rib is disposed by raising a part of the fins in the thickness direction.

12. A heat exchanger comprising:

flat pipes arranged such that flat surfaces of the flat pipes are opposed to one another; and fins each including:

insertion parts that extend in an insertion direction that is substantially perpendicular to:

a direction of arrangement of the flat pipes, and a longitudinal direction of the flat pipes, wherein at least part of each of the flat pipes is inserted into a corresponding one of the insertion parts;

cut-and-raised parts that are each disposed between adjacent ones of the insertion parts and raised from a main surface of each of the fins in a thickness direction of each of the fins; and a rib disposed between one of the insertion parts and one of the cut-and-raised parts, wherein the cut-and-raised parts are aligned in the insertion direction of the flat pipes, for each of the fins, the rib extends along the insertion direction of the flat pipes, each of the fins further includes another rib, and for each of the fins:

one of the ribs is disposed between a first side of one of the cut-and-raised parts and one of the insertion parts, and another of the ribs is disposed between a second side of the one of the cut-and-raised parts and another of the insertion parts.

13. The heat exchanger according to claim 12, wherein for each of the fins, the rib is disposed on an insertion advancing side in the insertion direction with respect to a contact part of one of the insertion parts, and the contact part contacts the flat pipes first when the flat pipes are inserted into the fins.

14. The heat exchanger according to claim 12, wherein each of the fins further includes a fin collar that fringes one of the insertion parts and opposes the flat surfaces of the flat pipes, and for each of the fins, the rib is disposed between the fin collar and one of the cut-and-raised parts.

15. The heat exchanger according to claim 12, wherein the rib is disposed by raising a part of the fins in the thickness direction.

* * * * *